United States Patent [19]

Hubler et al.

[11] Patent Number: 4,508,329

[45] Date of Patent: Apr. 2, 1985

[54] HIGH SPEED DUPLICATOR WITH STAPLER AND STAPLE LOADING ARRANGEMENT

[75] Inventors: Lawrence C. Hubler, Fairport; Joseph J. Ferrara, Webster; Roger N. Albright, Fairport; Raymond C. Bassett, Rochester, all of N.Y.

[73] Assignee: Xerox Corporation, Stamford, Conn.

[21] Appl. No.: 563,735

[22] Filed: Dec. 21, 1983

[51] Int. Cl.[3] ..... B42B 1/02

[52] U.S. Cl. ..... 270/53; 227/2; 227/120; 227/133; 227/134

[58] Field of Search ..... 270/53, 58; 227/2, 120, 227/124–125, 126, 129, 131, 132, 133, 134, 5–7, 1

[56] References Cited

U.S. PATENT DOCUMENTS

| | | | |
|---|---|---|---|
| 2,991,475 | 7/1961 | Allen | 227/134 |
| 3,049,715 | 8/1962 | Allen | 227/125 |
| 3,604,608 | 9/1971 | Mullaney | 227/120 |
| 3,884,408 | 5/1975 | Leiter et al. | 270/58 |
| 4,187,969 | 2/1980 | Spehrley, Jr. | 227/2 |
| 4,293,088 | 10/1981 | Barrett et al. | 227/120 |
| 4,358,197 | 11/1982 | Kukucka et al. | 270/58 X |
| 4,361,393 | 11/1982 | Noto | 270/58 X |
| 4,386,725 | 6/1983 | Chambers | 227/2 |
| 4,424,963 | 1/1984 | Bartholet et al. | 270/53 |
| 4,444,491 | 4/1984 | Rinehart et al. | 355/50 |

*Primary Examiner*—E. H. Eickholt

*Attorney, Agent, or Firm*—Bernard A. Chiama

[57] ABSTRACT

A staple loading arrangement for feeding sticks of staples in a stapler magazine under a constant, uniform force imposed upon a staple follower in the magazine to present individual staples to a stapling position whereat sheets are stapled and including a drive mechanism which will provide this force and a retraction device which when retracting the follower to permit staple loading also conditions the force producing device for another cycle of providing force after staples have been loaded into the magazine.

4 Claims, 4 Drawing Figures

HIGH SPEED DUPLICATOR WITH STAPLER AND STAPLE LOADING ARRANGEMENT

This invention relates to a reproduction system, or copying machine, having an improved finishing station for use in such system.

With the advent of higher speed and more sophisticated copy producing machines, printing presses, and the like, considerations as to how the mass of copies generated can best and most effectively be handled has assumed increasing importance. One way has been to provide a copying system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collecting station, a finishing device such as a stitcher or stapler is activated to bind the set. These systems are of the pre-collation type wherein the document sheets are pre-collated in the document handling apparatus prior to commencement of a reproduction run. The output for the reproduction machine will likewise be pre-collated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

Another type of copying arrangement known as a post-collation system utilizes document handling wherein a predetermined number of light images are produced for each document sheet, say for example, of page one of a multi-page document, before a successive document sheet, perhaps page two of the document is likewise imaged. This sequencing in turn may be repeated many more times if a very large number of copy sets are to be reproduced. As the copy sheets are being produced in accordance with the above imaging procedure, an array of collecting bins or sorter is positioned and vertically moved in either direction to receive the copy sheet output for collating the copy sheets into collated sets, if the system has been programmed for the sets mode of operation or into stacks if in the stacks mode of operation. The bin array or sorter in effect serves as a buffer in the production of finished copy sets when in the sets mode of operation. As these sets are being produced, a finishing device such as a stitcher or stapler is positioned and activated to apply a staple to each set as they are completed. A copying arrangement of this type is disclosed in U.S. Pat. No. 4,444,491 for which the present invention is particularly adapted for incorporation, and therefore the disclosure in this patent is herein incorporated by reference.

Regardless of whether the copying system is of the pre-collation type or of the post-collation type, the use of one or more stapling devices which utilize preformed staples has introduced problems regarding the loading of staples for each of the stapler heads associated with the stapler devices. Various types of cartridge loading devices or turret magazines have been introduced for this purpose, but reliability has not accompanied such usage. A high degree of malfunctions and poor quality production have rendered prior attempts of loading staples unacceptable.

It is therefore the object of the present invention to utilize a staple loading mechanism for a stapler associated with a copier or duplicator which provides maximum reliability of operation, and to minimize jam problems.

The present invention includes a stapling apparatus for binding copy sheets received in succession at a sheet collecting device, or sorter, having a series of individual bins each with an inlet for receiving individual sheets at a sheet receiving station, set transport means for removing each set of collected sheets from the bins; a pair of stapler devices for binding each set after removal from the sorter; and controls for the above.

Other objects and advantages will be apparent from the ensuing description and drawings in which.

Figure 1:
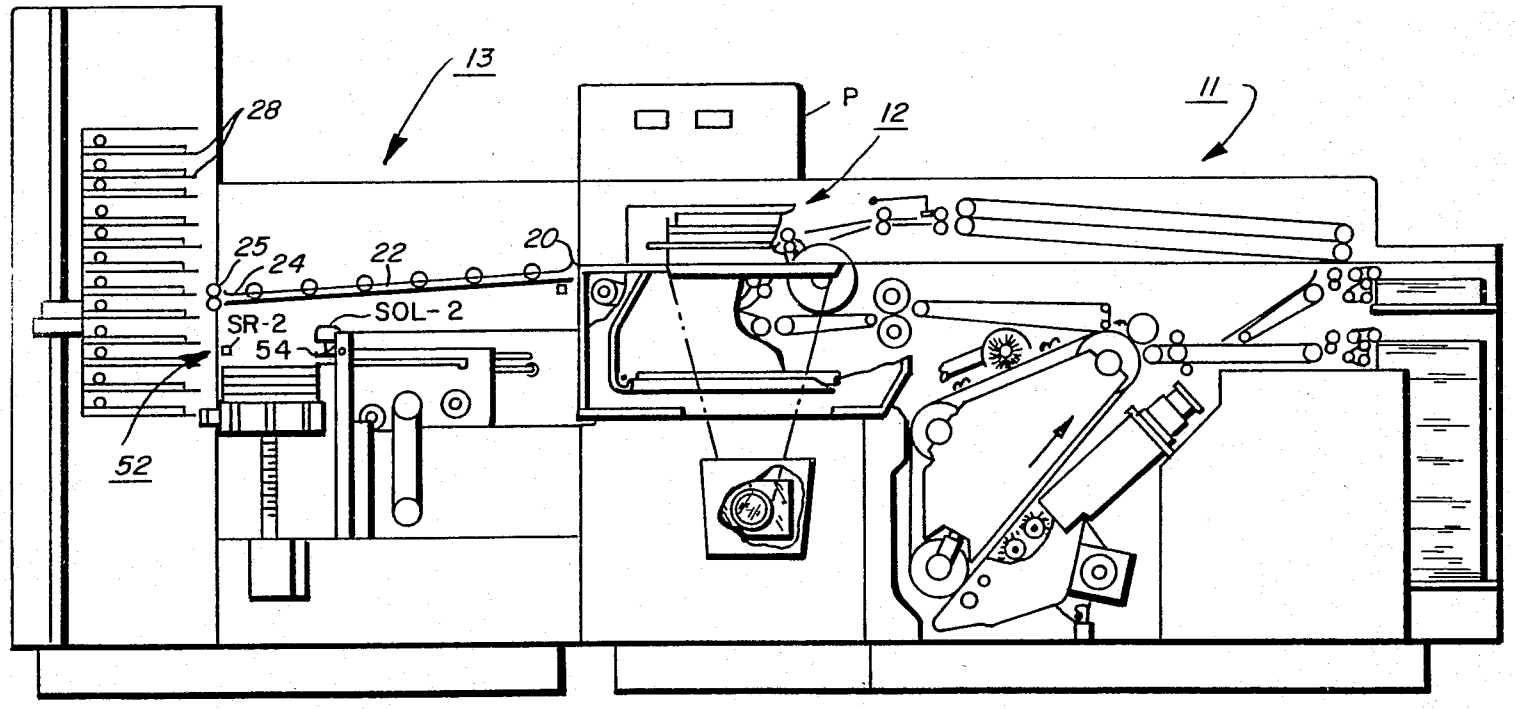
FIG. 1 is a schematic illustration of a configuration of an electrostatographic printing/stapling system employing the present invention.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commerical embodiment of the Xerox duplicators, models 9400 and 9500 which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein. For the complete apparatus and description thereof to which the present invention may be applied is illustrated and described in U.S. Pat. No. 4,444,491, commonly assigned, and which is incorporated by reference herein.

Copy sheets exiting the processor 11 are transported through an exit slot 20. The sheets are directed to the finishing station 13 which comprises a sorting mechanism, a stapler apparatus, and an output elevator/conveyor system. After leaving the processor 11, as shown in FIG. 1, each sheet is positioned upon a transport 22 to be further conveyed generally along the same horizontal plane as its previous path to a fixed receiving point or station 24.

At the exit slot 20, a sheet contacting switch SR-1 is positioned to be actuated as each sheet enters the transport 22 of the finishing station 13. The circuit for this switch is connected to the logic in the programmer P and serves to reset the machine clock for the finishing function so that zero time for the sheet commences when the sheet is at the reference point 24.

At the receiving station 24, there is positioned a pair of contacting transport rollers 25 which receive each copy sheet within the nip for directing a sheet into a bin of an array of collecting bins, or sorter generally indicated by the reference numeral 28. In the illustrated embodiment, the array 28 includes twelve horizontally disposed bins 30 arranged in a vertical column, the number of which corresponds to the predetermined number of exposures made of each document sheet while it is on the exposure platen for the copy processor 11.

The array 28 is mounted for bi-directional vertical indexing movement within a supporting fixed machine frame 32 and is positioned in its normal standby position with the lowermost bin opposite the nip of the rollers 25 at the fixed station 24. Details as to structural and operating sequences is described in the above referenced to U.S. Pat. No. 4,444,491.

As will be described hereinafter, a set stapling system in the form of a dual stapler apparatus is arranged immediately below the bin receiving point 24. This apparatus includes means to remove completed sets of collated copy sheets from every other bin to effect single or dual stapling along an edge of the set if so programmed or not stapling at all, and to position the stapled or unstapled sets on an elevator mechanism. In order to permit complete removal of the sets from all of the bins 30 in the array 28, the array must move twice relative to the point of set unloading.

The bin array 28 is driven vertically in either direction by a ball screw 34 connected to the shaft of a servo motor M-1 which is mounted to the base of the frame 32. These movements of the array are effected by a ball 35 secured to a rear wall of the array and through which the screw 34 is threadedly related. Rotation of the screw (which is fixed against axial movement) in either direction will impart corresponding up or down movement of the ball 35, and consequently the array.

Figure 3:
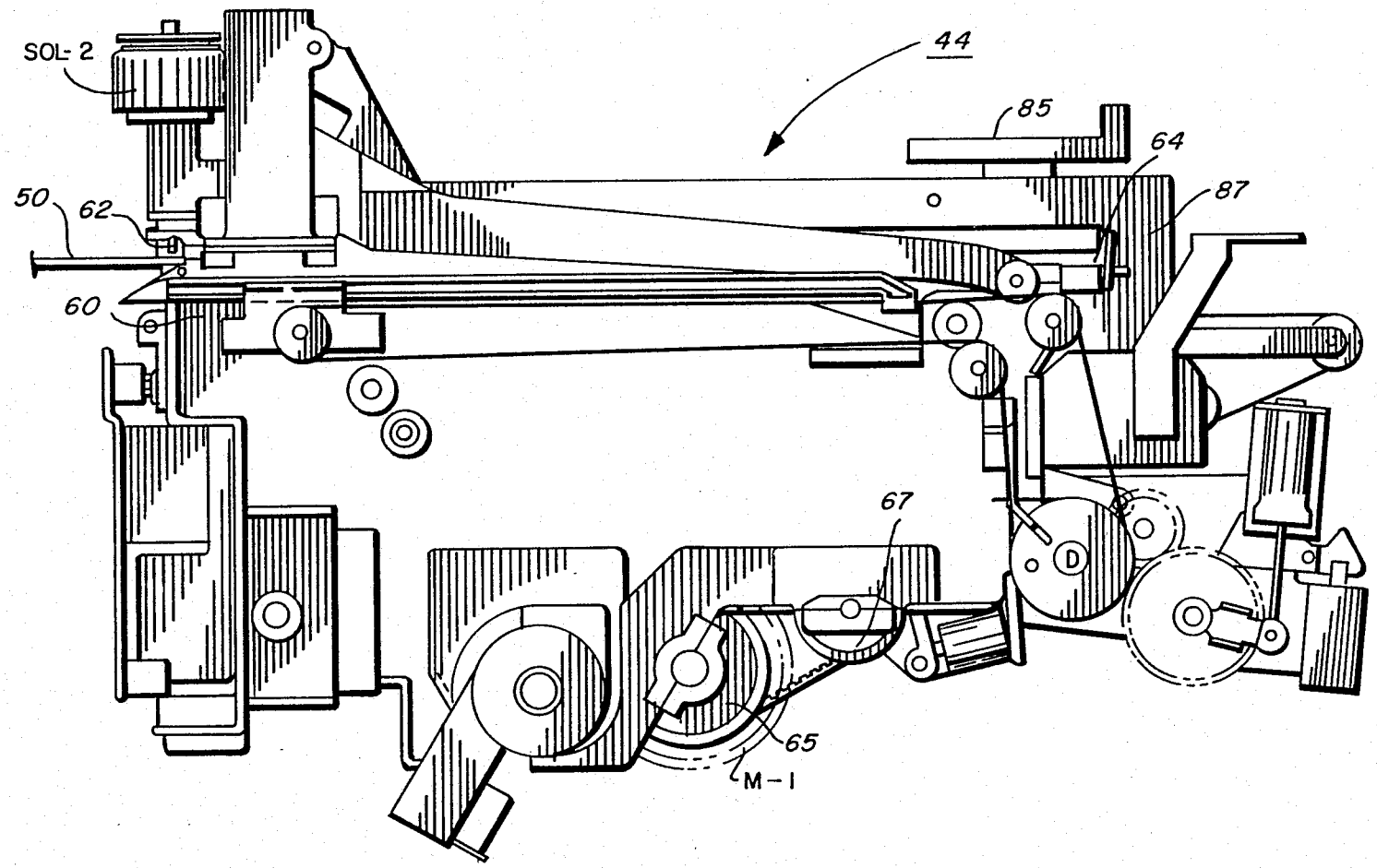
FIG. 3 is an elevational view of one of the stapling devices in the stapling station of FIG. 2.

After copy sheets, simplex or duplex, have been produced in the processor 11, transported by the transport 22 and collected in the bin array 28 while the system is in either the sets mode or the stacks mode, the collected sets are now in condition to be further processed by a finishing apparatus generally indicated by the reference number 40. The finishing apparatus 40 comprises five subassemblies each of which is programmed to operate in timed sequence with each other, with the system logic and programmer P, to be timed relative to the number of sets and copy sheets per set which were previously pre-programmed, and with the document sheet actuation of the apparatus 12. As shown in FIGS. 1 and 3, the finishing apparatus comprises a set transport 42, individually operable, and dual stapler devices 44. In conjunction with the finishing apparatus 40, the finishing station 13 also includes an elevator 46.

Figure 2:
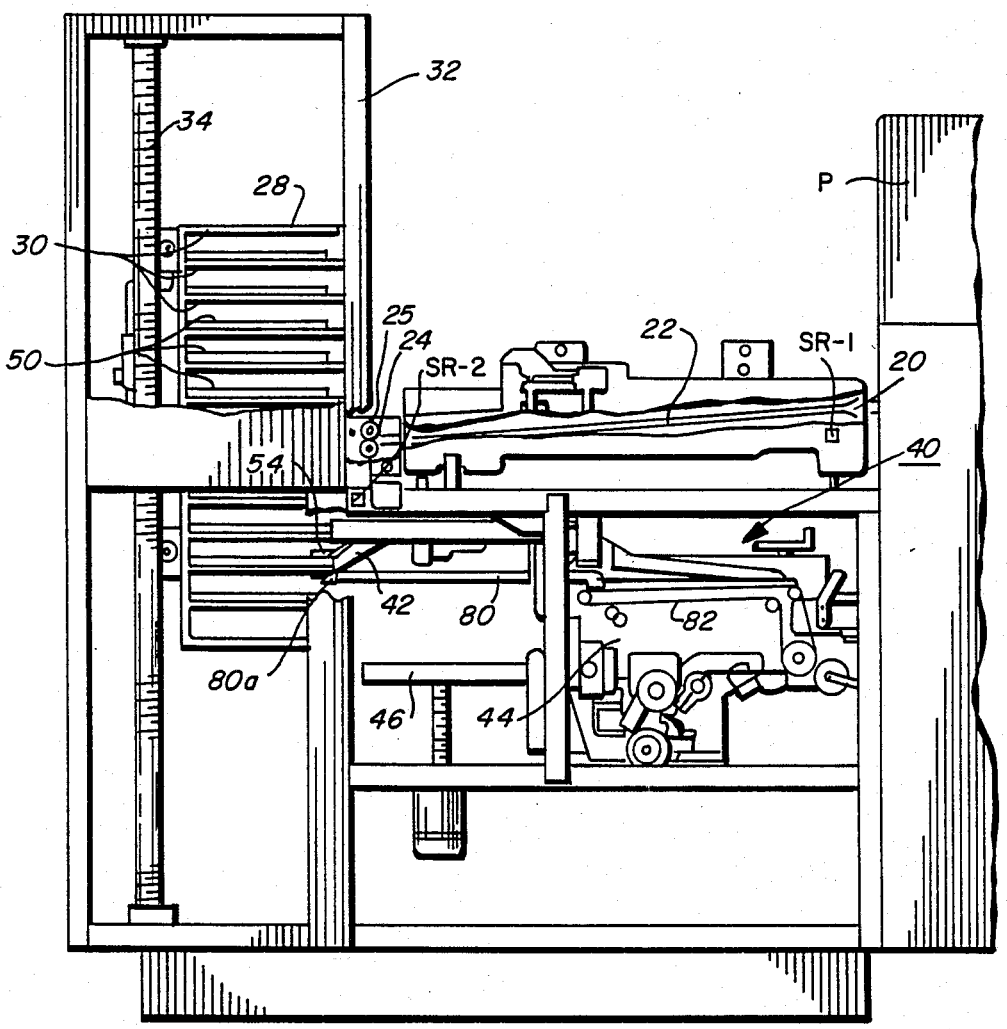
FIG. 2 is an elevational view of the stapling station utilized in the system of FIG. 1.

The set transport 42 is utilized to unload automatically sets or stacks of copy sheets from the bins at an unload station two copy cycle pitches or bins below the sorter bin load sstation at 24. As shown in FIG. 2, the set transport includes a clamp 54 which is adapted to grip an edge of a set or stack and convey the same from the bin array to the stapler apparatus 40 for a stapling operation, if that has been pre-programmed, or directly to the elevator 46 if programmed for the non-stapled mode.

The set transport 42 also includes a reversible servo motor (not shown) to effect reciprocable movement of the clamp 54 to the sorter to a set gripping position, in the opposite direction to a set stapling position, and still further in that direction, to retract the clamp, all in cyclic actuation. In moving toward the sorter 28, the clamp 54 is sensed by a sensor SR-2 mounted on the frame for the sorter to zero reference the positioning of the set transport as a timing monitor of subsequent timed events in the finishing function. The clamping and unclamping action of the clamp is provided by a solenoid valve in a suitable pneumatic power device which may be operatively connected to the jaws.

The stapler apparatus 40 as shown in FIG. 2 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 60, such as the Bostitch staple head indicated as the 62-E manufactured by the Bostitch Division of Textron Corporation of Providence, Rhode Island. Since the stapler mechanisms, drives therefor, and related structure are identical, only one will be described.

As shown in FIG. 3, the stapler device 44 comprises the stapler head 60 having a clamping position 62 to which an edge of each copy set is transported by the set transport 42. At the position 62, the stapler head 60 is adapted, upon energization of a solenoid SOL-2 to effect clinching of the legs of a staple after the same has been separated from a stick of staples within a staple magazine 64 in the lead 60, driven by a driver (not shown) in the head 60 through the sheets of the copy set in the conventional manner. With one or more staples being driven through the sheets of the copy sets, clinching of the staple legs is then accomplished by the energization of the solenoid SOL-2, as aforesaid.

Stapling in the stapling device 44 is accomplished by a drive system including a drive pulley 65 connected to the shaft of a drive motor M-1 for driving both devices 44. further details of this drive system and staple drive is fully disclosed in the above referred to U.S. Pat. No. 4,444,491 which is hereby incorporated by reference and therefore are not necessary for understanding the present invention. In operation of the stapling devices 44, the motor M-1 is in continuous operation and electromagnetic wrap spring clutches within the stapling drive system are energized at approximate timed relationship to drivingly convert the motor M-1 to the various gears and pulley to effect clamping of a copy set within the clamping station 62, driving of one or more staples through the edge of the copy set being bound, and clinching of the staple legs by energization of the solenoid SOL-2, as aforesaid.

Figure 4:
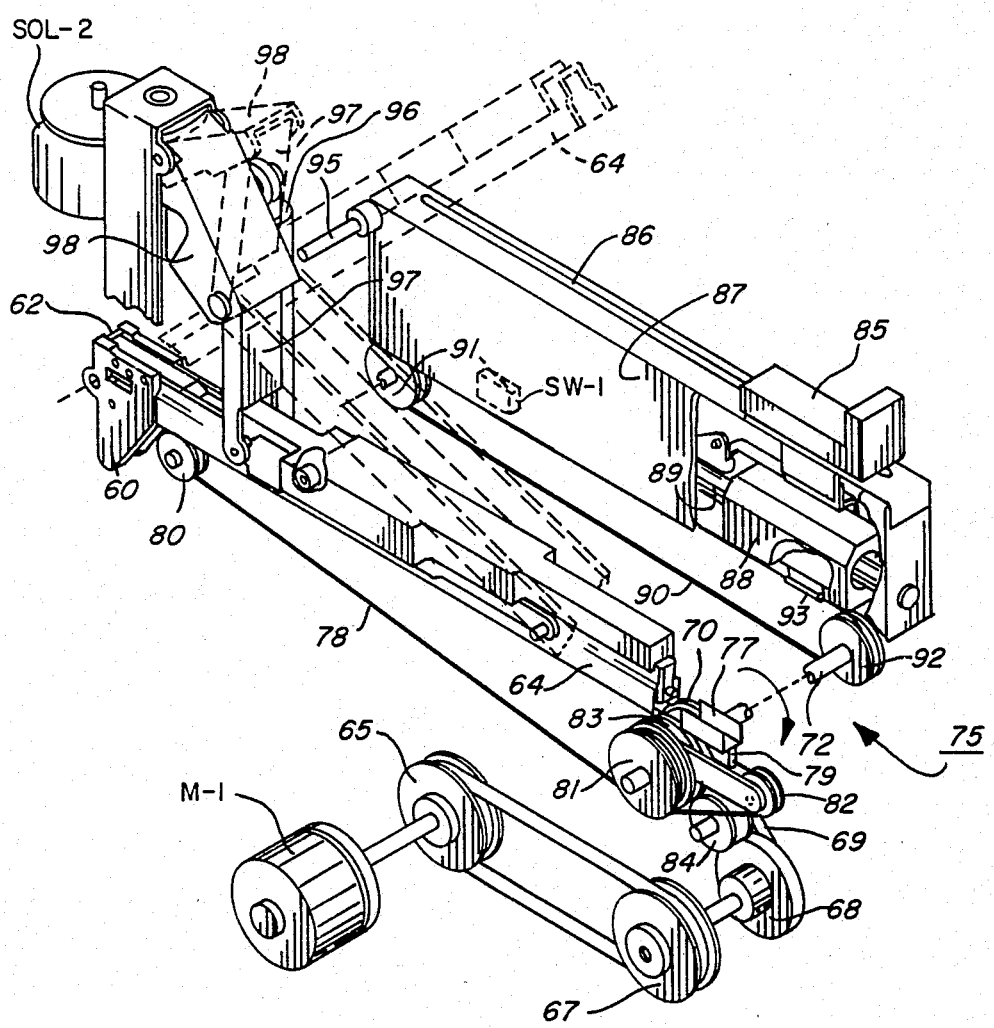
FIG. 4 is an isometric view of a stapling device showing full line arrangement in readiness for a staple feed operation and dotted line arrangement for staple loading operation.

The present invention utilizes drive power as a braking force from the motor M-1 by a drive train of timing belts and gears as will be presently described. As shown in FIGS. 3 and 4, the pulley 65 for the motor M-1 is connected by a timing belt to a pulley 67 mounted on a shaft supporting a pulley 68, which in turn, is connected by a timing belt 69 to drive a slip or over-running one way clutch 70 secured to a shaft 72 of a drive mechanism generally indicated by the reference numeral 75 (see FIG. 4). The drive mechanism 75 is utilized to drive a staple follower or slipper against the rear end of a row of staple sticks in each of the stapler heads 60 for the stapler devices 44 in one mode of operation and to drive the staple slipper rearwardly and out of the stapler head to permit reloading of staples, in another mode of operation.

As shown in FIG. 4, the staple head magazine 64 is elongated and of a length preferably adapted to contain four or five commercial staple sticks of about 165 staples each. The magazine is of the conventional type as in most desk-type staplers except that the channel within the head is inverted so that the staples contained therein have their legs extending upwardly. A staple follower or slipper 77 is shown removed form the magazine preparatory to the reloading of the magazine, as will be described below.

The follower 77 is adapted to be driven very slowly within and along the channel formed in the magazine throughout most of its length, driving therewith the staples before it. At the other end of the magazine, at the clamping position 62, staples are driven one at a time from the adjacent end of a stick of staples in the customary operation of the staple device 44.

As the staples are consumed, the follower 77 travels toward the position 62. This forward motion is imparted to the follower 77 by means of a cable 78 to which the follower is attached by an internal clip 79. The cable 78 extends along the longitudinal axis of the magazine 64 from the clip 79 forward to and around a pulley 80 secured to the frame of the stapler device, then returning to the rear of the magazine, around a capstan pulley 81 for a few turns, then around a more rearward postioned pulley 82 back to the follower 77. The capstan pulley 81 is secured to the shaft 72 and has mounted thereon and concentric therewith a constant torque spring 83 which has its inner end secured to the shaft 72. The other end of the spring 83 is connected to a spring supply spool 84 secured to the stapler device.

In normal operation of the staple driving means so far described, the spring 83 has been wound by a mechanism to be described below. The magazine 64 has been fully loaded with staple sticks and the follower 77 is against the rearmost staple. The spring supplies an even, constant and steady force upon the follower for the entire length of its travel to where a low staple condition is experienced as predetermined by machine conditions. Upon reaching a low staple condition, wherein a few staples remain of a predetermined number, as detected by a switch SW-1, the control for the motor M-1 will assume operation as discussed below. The switch SW-1 is operatively connected to the Programmer P which is arranged to provide the operator with an indication that there is a low staple condition. When a low staple condition is sensed and indicated, sufficient staples still remain in the magazine 64 to permit completion of a reproduction run for which stapling had been programmed or to a segment of the reproduction run which is a multiple or a division of the total number of copy sets to be produced. For example, if a low staple condition is sensed when the bin array 28 is only partially filled, the Programmer P will permit the completion of filling the bin array before causing system shutdown. After any of these events, the motor M-1 will become deenergized to shut down the apparatus 40 and the entire system.

The return of the follower 77 to its retracted position as shown in FIG. 4, the wind up of the spring 83 and the additional conditioning of the magazine 64 for reloading is provided by a staple reload arrangement and drive therefor. The reload arrangement includes a manually operated latch mechanism having a handle 85 slidably mounted in an elongated slot 86 formed in a housing 87 mounted on the frame of the stapling apparatus. The slot is approximately 70% as long as the magazine and is mounted to be closely adjacent thereto. The handle 85 extends within the housing 87 and is mounted upon a member 88 which is supported for sliding movement upon an elongated rod 89 which extends the length of the housing.

A drive cable 90 supported for bidirectional movement below the housing 87 is entrained around a forward pulley 91 and a rear pulley 92 secured to the shaft 72, both being supported below the ends of the housing. The cable is secured to the latch member 88 by means of a bracket 93 so that upon reciprocable motion of handle 85, the cable 90 moves correspondingly therewith.

As shown in FIG. 4, the cables 78 and 90 are operative in parallel planes and the extent of movement of the follower 77 and the bracket 93, respectively, are the same in both direction and distance. The slip clutch 70 is mounted for operation on the shaft 72 with the pulley 92 with the slip of the clutch being such that as the shaft turns in the direction of the arrow, there is slippage in the pulley of the clutch and no drive is imparted to the belt 69 and pulley 68.

In operation of this portion of the staple load mechanism, after a low staple condition is sensed and the system has shut down, the motor M-1 is deenergized. The operator manually returns the reload handle 85 to its rearmost position, as shown in FIG. 4, from a position which, at low staple condition, would be at the forward end of fthe slot 86 (left end as viewed in FIG. 4). This movement of the handle 85 produces corresponding movement of the upper run of the cable 90 which causes the shaft 72 to turn in the direction of the arrow. In this rotation, the clutch 70 slips and the spring 83 winds up upon the shaft 72. This rotation of the shaft 72 also produces rotation of the capstan pulley 81 to return the follower 77 to its most rearward position and out of the magazine 64, into a storage space, as shown in FIG. 4.

With the parts in their respective position as shown in FIG. 4 in full lines, the magazine may be pivoted to its position as shown in dotted lines about a pivot pin 95 secured to the forward end of the housing 87. A suitable latch, not shown, may be mounted on the housing 87 to permit the operator to lock the magazine during normal stapling operation and to release the magazine to its loading position as shown in dotted lines. While in the loading position, the operator may insert one to four staple sticks. A counterbalance device in the form of a gas cylinder 96 serves to articulate pivotally joined elements 97, 98 connected to the magazine adjacent the pivot pin 95 and the stapler frame. The gas cylinder serves to buckle the joined elements and thereby facilitate easy pivotal movement of the magazine to both of its positions. The motor M-1 serves as a brake to limit the speed of movement of the follower 77 under the force of the spring 83 until the follower contacts the end of the last stick of staples.

From the foregoing, it will be appreciated that the present invention insures continuous staple drive at uniform speed and under uniform force over a long distance wherein greater numbers of preformed staples may be contained. The staple drive arrangement also allows easy access to an operator for loading a relatively large number of staples.

While the invention has been described with reference to the structure disclosed, it is not confined to the details set forth, but is intended to cover such modifications or changes as may come within the scope of the following claims.

We claim:

1. In a stapling apparatus having a clamping/stapling position whereat a plurality of sheets to be stapled are clamped preparatory to the application of a staple thereat, a magazine for holding one or more sticks of staples, and a staple follower within the magazine for contacting the end of a stick, the improvement comprising:

drive means engageable with the follower and adapted when in its release mode to provide a force thereon in a direction to force the staples toward the clamping/stapling position, means for retracting the follower out of the magazine for permitting loading thereof with sticks of staples, said means for retracting the follower being operatively connected to said drive means for conditioning the same to its release mode, and means for selectively controlling said drive means between its non-release mode and its release mode.

2. In a stapling apparatus having a clamping/stapling position whereat a plurality of sheets to be stapled are clamped preparatory to the application of a staple thereat, a magazine for holding one or more sticks of staples, and a staple follower within the magazine for contacting the end of a stack, the improvement comprising:

spring means engageable with the follower and adapted when unwinding to provide a force thereon in a direction to force the staples toward the clamping/stapling position, means for retracting the follower out of the magazine for permitting loading thereof with sticks of staples, said means for retracting the follower being operatively connected to said spring means for winding the same during retracting of the follower, and means for selectively releasing said spring means to effect unwinding thereof and thereby provide a force on the sticks of staples toward the clamping/-stapling position.

3. In a stapling apparatus having a clamping/stapling position whereat a plurality of sheets to be stapled are clamped preparatory to the application of a staple thereat, a magazine for holding one or more sticks of staples, and a staple follower within the magazine for contacting the end of a stick, the improvement comprising:

means associated with the follower and adapted to provide a force thereon in a direction to force the staples toward the clamping/stapling position when in one condition of operation, means for retracting the follower out of the magazine for permitting loading thereof with sticks of staples, said means for retracting the staple follower being operatively connected to said force providing means for placing the same in said one condition of operation, and means for maintaining said force providing means inoperative relative to providing a force upon the staple follower, and for selectively releasing the force.

4. In a copier having a document handling apparatus adapted to circulate a set of document sheets, copy sheet processor and a collator arranged to receive processed copy sheets representative of the set of document sheets, the improvement comprising:

stapling apparatus having a clamping/stapling position whereat a collated set of copy sheets indicative of the set of document sheets are clamped preparatory to the application of a staple thereat, a magazine for holding one or more sticks of staples, and a staple follower within the magazine for contacting the end of a stick, the improvement comprising:

drive means engageable with the follower and adapted when in its release mode to provide a force thereon in a direction to force the staples toward the clamping/stapling position, means for retracting the follower out of the magazine for permitting loading thereof with sticks of staples, said means for retracting the follower being operatively connected to said drive means for conditioning the same to its release mode, and means for selectively controlling said drive means between its non-release mode and its release mode.

* * * * *